United States Patent [19]

Roy et al.

[11] 4,200,401

[45] Apr. 29, 1980

[54] PRINT WIRE SOLENOID

[75] Inventors: Kenneth L. Roy, Centerville; Philip E. Fugate, Dayton, both of Ohio

[73] Assignee: Ledex, Inc., Dayton, Ohio

[21] Appl. No.: 908,153

[22] Filed: May 22, 1978

[51] Int. Cl.[2] ..... B41J 3/10

[52] U.S. Cl. ..... 400/124; 101/93.05; 335/261

[58] Field of Search ..... 400/124; 101/93.05; 335/255, 261, 274

[56] References Cited

U.S. PATENT DOCUMENTS

| | | | |
|---|---|---|---|
| 3,523,992 | 8/1970 | Bickoff | 101/93.48 X |
| 3,675,172 | 7/1972 | Petusky | 335/257 |
| 3,690,431 | 9/1972 | Howard | 400/124 |
| 3,729,079 | 4/1973 | Zenner et al. | 400/124 |
| 3,755,700 | 8/1973 | Buschmann et al. | 400/124X |
| 3,787,791 | 1/1974 | Borger et al. | 400/124 X |
| 3,850,278 | 11/1974 | Mihm et al. | 400/124 |
| 3,897,865 | 8/1975 | Darwin et al. | 400/124 |
| 3,994,382 | 11/1976 | McIntosh | 400/124 |
| 4,044,455 | 8/1977 | Watanabe et al. | 101/93.29 X |
| 4,087,773 | 5/1978 | Jencks et al. | 335/243 |
| 4,125,336 | 11/1978 | Chu | 400/124 |
| 4,137,513 | 1/1979 | Reece et al. | 400/124 X |

OTHER PUBLICATIONS

*Electromagnetic Devices*, by Herbert C. Roters, John Wiley & Sons, Inc. 1941, pp. 433, 434, 435.

*Primary Examiner*—Paul T. Sewell

*Attorney, Agent, or Firm*—Biebel, French & Nauman

[57] ABSTRACT

A print wire solenoid for high-speed operation is made with two major components or subassemblies. The first is a plastic injected unitary bobbin or stator assembly which incorporates a core ring and a core, and a stator which forms a bobbin for receiving an electric coil. The parts in the stator are positioned and molded to a datum surface. The second major subcomponent is a unitary armature assembly which incorporates an armature, a retraction spring, and a print wire, all anchored to a plastic body. These parts are likewise positioned with respect to a datum surface. The stator assembly and armature assembly are retained within a drawn metal case, and a rebound disc is positioned within the case and locates the datum surface of the armature assembly in the same plane as the datum surface of the stator assembly so as to define an accurate working air gap.

10 Claims, 12 Drawing Figures

PRINT WIRE SOLENOID

BACKGROUND OF THE INVENTION

This invention relates to the field of axial solenoids and more particularly to the print wire solenoids for use in dot matrix impact type printers and the like, such as illustrated in the United States patents of Zenner et al, U.S. Pat. No. 3,729,079 or Howard, U.S. Pat. No. 3,882,986, as examples only.

A typical print head for a dot matrix type of printer may have either seven or nine wires, each operated by an individual print wire solenoid. High speed operation of such printers may require the ability to produce in excess of 600 characters per second with an average of six dots per character. An individual print wire may be required to produce in excess of 1,000 impacts per second, while maintaining a clear and distinct impact pattern.

Each impact dot produced by the wire represents a complete cycle of operation for the print wire solenoid, in which a coil is energized to move an armature from a rest position to a forward or actuated position. The print wire is carried on or operated by the armature and moved into impact with the printing medium. When the energization on the solenoid coil is removed the armature returns to its rest position. Total movement of the armature usually does not exceed 0.040" and more commonly has a movement in the range of 0.020". The return momentum of the armature must be absorbed with minimum rebound so that the unit is capable of high speed operation.

In the mass production of such solenoids it is important that they be designed so as to be produced at low cost and yet provide repeatability of design performance from unit to unit. In other words, it is important to provide a design in which the speed of operation and force of application will remain within desired limits throughout a production run. One critical design parameter of a solenoid of this type is that of providing a precise air gap between the armature and stator. Thus, it is important that the working air gap, across which the motive force is generated, be accurately maintained from unit to unit. In the past, threaded external adjustments have been provided through which a desired air gap could be reestablished after the solenoid had been assembled. The problem in maintaining a precise internal air gap has resulted from the difficulty in controlling the stack-up of the tolerances of the many assembled parts, the total axial variations which result in a loss of control of the desired air gap dimension within the assembled part.

A further difficulty which has been experienced is that of proper coupling of the print wire to the solenoid. Epoxy glues, swaging, brazing and welding have been employed with varying degrees of success and reliability. The failure of the attachment of a printing wire to the armature has been a major cause of failure of print wire solenoids.

A further difficulty which has been encountered in the print wire solenoids is that their operation may become erratic at the higher speed levels. This erratic operation can be caused by a number of factors, including friction, rebound of the armature, failure to maintain the desired air gap, and slipping of the print wire at the armature, among others.

SUMMARY OF THE INVENTION

This invention is directed to an improved print wire solenoid adapted for mass production which overcomes the difficulties encountered above, which has excellent repeatability of performance, and which is capable of stable high speed operation in excess of 1,400 impacts per second. Provision in the design and manufacture is made so that a uniform air gap is maintained, without the necessity of providing either internal or external air gap adjustments. The print wire is structurally bonded to the armature so as to eliminate failures by reason of the wire becoming unattached.

These advantages are accomplished in the present invention by providing major subassemblies which are injection molded. Insert molding is employed to provide a stator and bobbin assembly on the one hand and an armature assembly on the other hand. The stator and bobbin assembly incorporates, in a single unitary structure, a magnetic core, a magnetic core ring, and the stator ring, in precise alignment within a plastic spool. The spool in turn defines the bobbin, a mounting and print wire guide extension on one end, and the armature support on the other end. The armature assembly is also a unitary structure which incorporates a sleeve-type armature, a return spring, the print wire, and has a plastic body which defines a rebound land or surface. The subassemblies are retained in assembled form within an outer case, preferably of drawn steel.

By forming the stator and bobbin assembly and the armature assembly as unitary parts, most of the problems with variations due to "stack-up" of tolerances are eliminated. Thus, a given air gap is maintained over close limits without the necessity of providing mechanical adjustments or selective assembly. The print wire is advantageously molded into the armature assembly by injection molding and is effectively bonded to the armature assembly without the necessity for epoxy binding, swaging, welding, or the like.

In the preferred embodiment of the invention, both the stator and bobbin assembly, and the armature assembly, are designed to a common datum line or surface. When the case is assembled it retains a rebound or impact plate shock abosrber at this datum surface and defines the retracted or rest position of the armature.

An important object of the invention is the provision of a print wire solenoid, as outlined above, in which the stator assembly, including the stator core and pole parts are molded into a unitary part and in which the plastic body also forms the bobbin.

Another object of the invention is the provision of a print wire solenoid in which the armature, the return spring, and the print wire are molded in a unitary part.

A still further object of the invention resides in the construction of a print wire solenoid in which a bobbin and core assembly and an armature assembly are molded to a common datum or reference plane.

A more particular object of the invention is the provision of a print wire solenoid in which the printing wire is captured and retained within an armature by injection molding.

Another object of the invention is the provision of a print wire solenoid which incorporates a split armature and a split core for increased current rise and reduced response time.

These and other objects and advantages of the invention will be apparent from the following description, the accompanying drawings and the appended claims.

DESCRIPTION OF THE PREFERRED EMBODIMENTS

Figure 1:
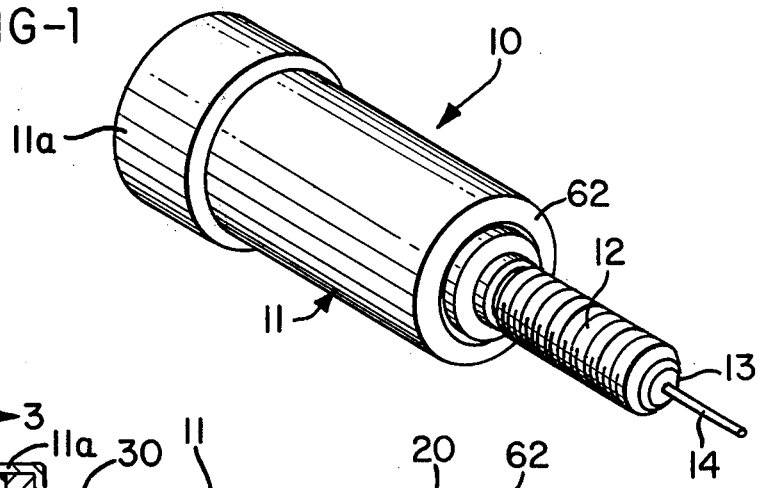
FIG. 1 is a perspective view of a print wire solenoid made according to this invention.

A tubular print wire solenoid constructed according to this invention is illustrated generally at 10 in FIG. 1. The assembly includes an outer sheet metal case 11 formed of suitable magnetic flux-carrying material, such as mild steel. The forward end of the solenoid is shown which incorporates a threaded extension 12 by means of which the solenoid 10 may be mounted. A flat 13 may be formed on the extension 12 for the purpose of mounting in a correspondingly shaped opening of a panel, support or the like. The print wire 14 is shown as extending through the portion 12. If desired, other mounting arrangements may be employed, as described hereinafter.

Figure 5:
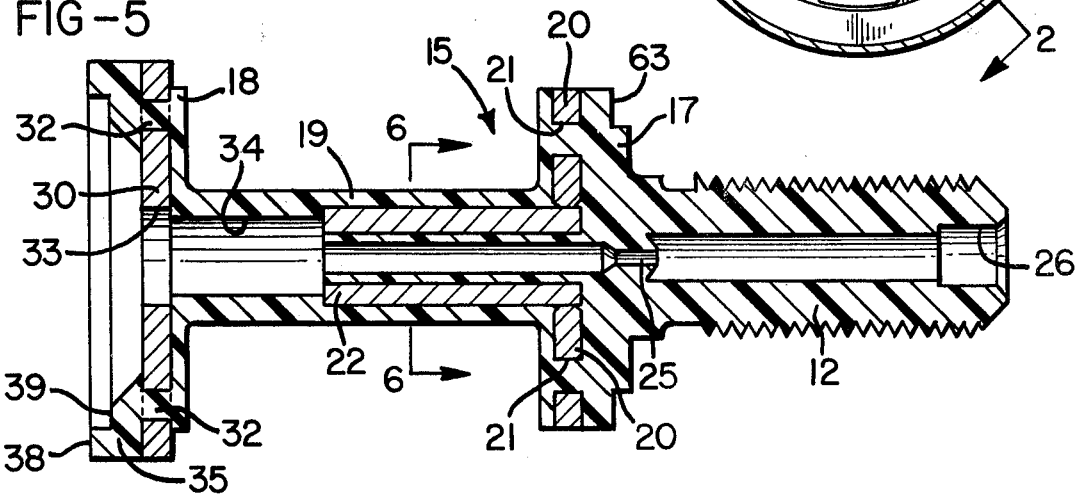
FIG. 5 is a longitudinal section through the stator and bobbin assembly portion of the solenoid.
Figure 7:
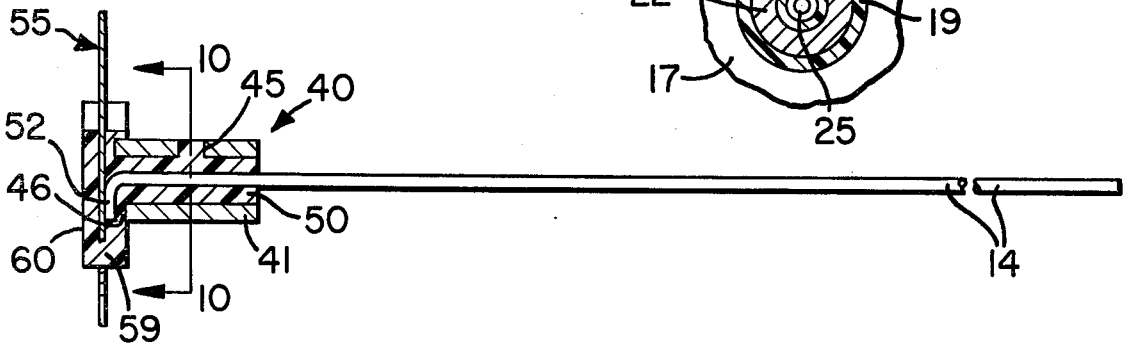
FIG. 7 is a longitudinal section through the armature assembly.

The solenoid 10 includes two major unitary subassemblies illustrated in FIGS. 5 and 7 respectively. One of these subassemblies consists of an injected molded unitary stator and bobbin assembly illustrated generally at 15 in FIG. 5. This assembly includes an injection molded plastic bobbin which has a front wall 17 and an axially spaced rear wall 18 joined by a tubular center section 19, thereby defining a spool or bobbin shaped region into which a coil of electric magnetic wire may be wound.

The front wall 17 forms an integral part of a forwardly extending combined mounting and printing wire extension 12 by means of which a solenoid may be suitably mounted on a printing head. While the forward extension 12 is shown in FIG. 5 as being threaded, it is understood that many modifications may be made of this portion within the scope of the invention, and thus integral retaining fingers may be molded in the outer surface to spring out when inserted through an opening or other variations may be made so as to accommodate the particular mounting as may be required.

The front wall 17 encapsulates a ferrous metal core ring 20. As shown in FIG. 5, the core ring 20 is formed with a number of axial openings 21 therein through which the plastic material of the bobbin may flow during the injection molding.

Figure 6:
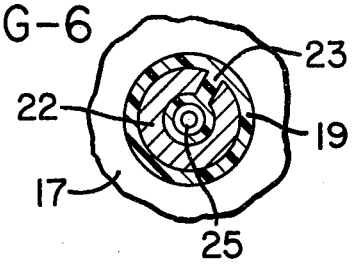
FIG. 6 is a transverse section through the stator and bobbin assembly taken generally along the line 6—6 of FIG. 5.

The tubular section 19 of the bobbin encapsulates a cylindrical core 22 also formed of ferrous metal. The core 22 has a forward end received in telescopic relation with the inside diameter of the core ring 20. While separate pieces are shown for the parts 20 and 22, it is understood that this portion of the stator magnetic structure may be formed as a single piece, if desired. Preferably, the core 22 is formed with a longitudinally extending slit 23, as shown in the end view of FIG. 6. The slit 23 has the function of increasing the effective magnetic surface, increasing the rate of current rise, and decreasing eddy currents in the core.

Within the central region of the front wall 17 the plastic material is necked down to form an internal print wire guide 25. The guide 25 forms a rather loose fit with the wire 14 and has the function of reducing sine wave osciallations in the wire 14 on impact. The forward end of the extension 12 is provided with an enlarged recess 26 into which a suitable wire guide or bearing is received.

The rear wall 18 integrally encapsulates a stator ring 30 also formed of ferrous metal. The stator ring 30 is of somewhat larger diameter than the core ring 20 and is provided with axial openings 32, through which the plastic material may flow during injection. The central opening 33 in the stator ring 30, together with the tubular section 19 rearward of the core 22, forms a cylindrical armature-receiving opening or bearing surface 34.

An annular portion 35 of the plastic material extends axially rearwardly of the ring 30 at the diameter of the ring 30 and forms a rear or outer radial land or surface 38 and an inner annular land 39 of somewhat smaller diameter than the outer land 38. The land 38 is also a datum plane, and in the injection molding of the assembly 15, all of the insert parts are positioned with respect to this plane.

Figure 8:
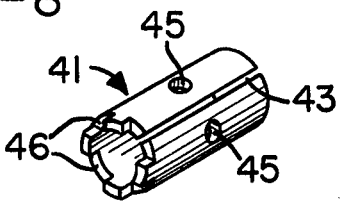
FIG. 8 is a perspective view of the tubular armature prior to molding.

The other major subassembly consists of an injection molded unitary armature and retraction spring assembly which is illustrated generally at 40 in FIG. 7. The assembly 40 includes a sleeve-shaped ferrous metal armature 41, also shown in perspective in FIG. 8. The sleeve armature is provided with a longitudinal slit 43 therethrough by means of which the effective magnetic surface area is increased, providing a more rapid magnetic flux build-up and reduced eddy currents. Holes 45 in the wall of the armature, and slots 46 in the inner end, provide areas for the plastic material to grip the armature and retain it under the severe shock and vibration incurred during printing. The armature 41 is retained in the assembly 40 by injection molding with plastic material which forms a body 50. At the same time, the inner end of the print wire 14 is captured within the armature. The wire 14 has a turned end 52 positioned in abutment with a cantilever or cruciform-shaped return spring 55. The spring 55, armature 41 and wire 14 are bound into the unitary assembly 40 by means of the plastic body 50.

Figure 9:
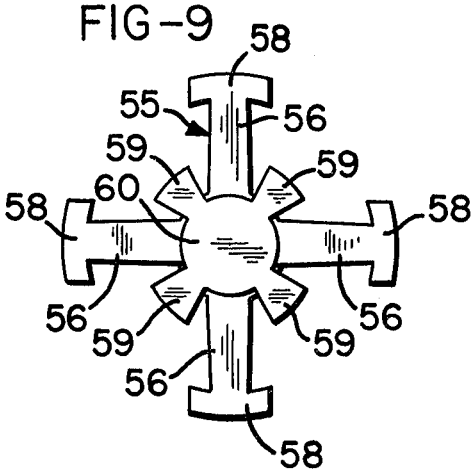
FIG. 9 is a rear elevational view of the armature assembly.

The spring 55 is formed with a plurality of radially extending arms 56 as shown in the end view of FIG. 9. The spring arms 56 terminate in enlarged arcuate support ends 58.

The plastic body 50 is formed with a plurality of radially outwardly extending tabs 59 positioned arcuately between the spring arms 56 and which define a common back planar surface 60. The tab surfaces 60 provide additional area for rebound surface for the armature assembly 40.

Figure 10:
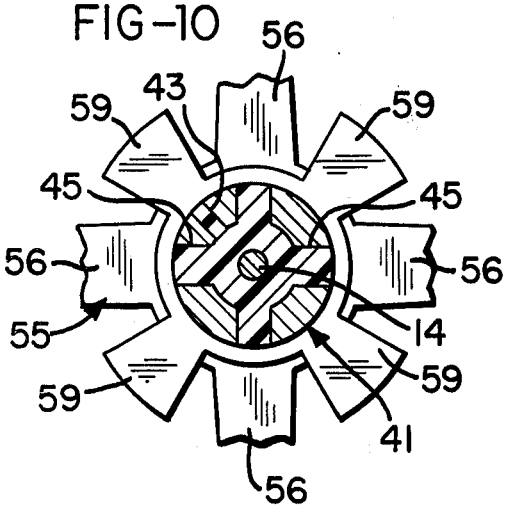
FIG. 10 is an enlarged transverse section through the armature assembly looking generally along the line 10—10 of FIG. 7.

The print wire 14 is effectively captured and bonded within the armature by injection molding of the armature 41, the wire 14 and the spring 55 into the unitary assembly 40. The end 52 effectively captures the wire 14 in the plastic body. The plastic material will flow through the openings 45 to the outer cylindrical surface of the armature 41 and will also flow through the slot 43 to the outer surface, as shown in FIG. 10. The rear surface 60 of the armature assembly 40 is the datum surface from which all of the metal parts of the assembly 40 are positioned, including the armature sleeve 41 and the spring 55.

Figure 2:
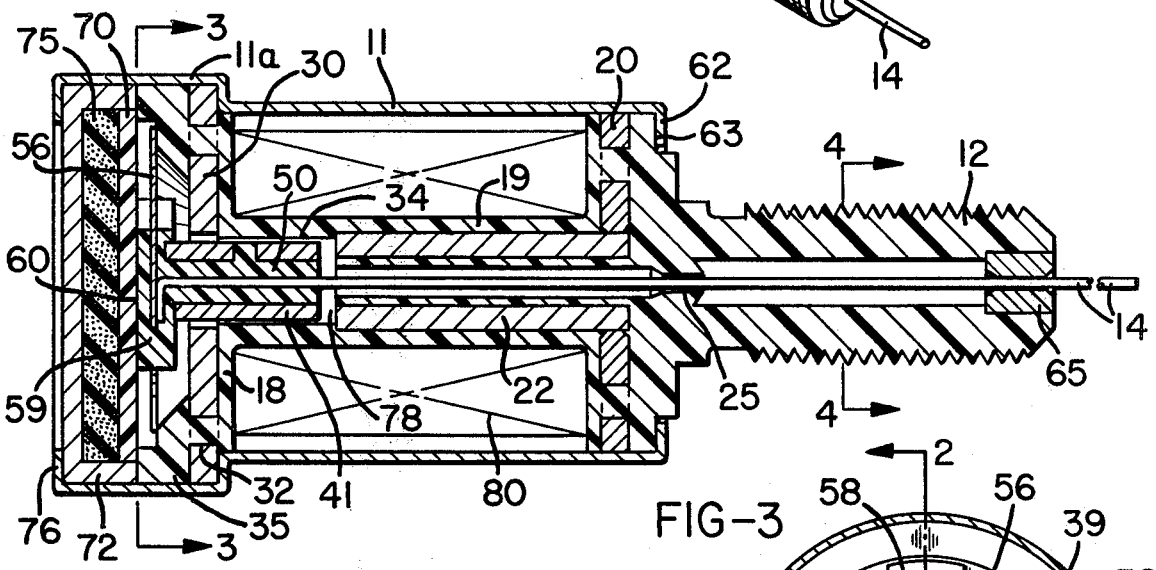
FIG. 2 is an enlarged longitudinal section through the solenoid taken generally along the line 2—2 of FIG. 3.
Figure 3:
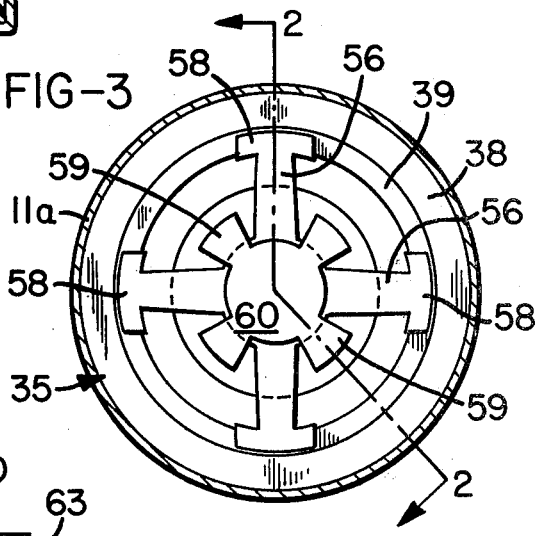
FIG. 3 is a transverse section through the solenoid looking generally along the line 3—3 of FIG. 2.
Figure 4:
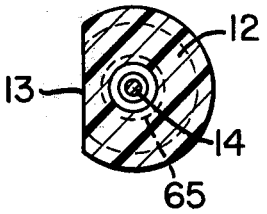
FIG. 4 is a transverse section through the front extension portion of the solenoid taken generally along the line 4—4 of FIG. 2.

Referring now to the assembled views FIGS. 2 and 3 of the solenoid of this invention, it will be seen that the case 11 is provided with a region of slightly larger diameter 11*a* to receive the enlarged wall 35 of the stator and bobbin assembly 15, and to accommodate the somewhat enlarged stator ring 30. This case 11 may be drawn of mild ferrous material and is formed with a forward inwardly turned end 62 which engages the radial front wall surface 63 of the assembly 15. The extension 12 thus extends forwardly through the opening defined by the inwardly turned end 62 of the case 11, and when the assembly 15 is inserted within the case, the outer surface of the core ring 20 and the common outer surface of the front wall 17 form a close fit with the inside diameter at the forward end of the case 11 in such a manner that the ring 20 is magnetically coupled to the case 11.

The armature assembly 40 may then be inserted into the position shown in FIG. 2, and in this position, the arcuate ends 58 of the retraction spring 55 rest on the annular ledge or surface 39 of the rear wall extension 35 with the print wire 14 extending forwardly through the core 22 and through the restricted opening defined by the necked-down portion 25. A suitable low friction, long wearing bearing 65 is received within the recess 26 and forms a close running fit with the wire 14. The outside diameter of the armature element 41 forms a close running fit with the cylindrical bearing surface 34 of the bobbin assembly 15. The opening 33 within the stator ring 30 forms a clearance fit with the armature element 41, which clearance is shown in somewhat exaggerated form in FIG. 2. In actual practice it is preferred to have a closely coupled relation between the armature and the stator ring. The outside diameter of the stator ring 30 forms a close fit with the case 11 at the enlarged portion 11*a*, thus completing the magnetic flux path.

After the armature assembly 40 is inserted with the arms 56 of the retraction spring 55 resting on the ledge 39 as described above, an impact disc 70 of relatively thin material is inserted with its peripheral edge resting on the rear datum surface 38. In this position, the impact plate 70 engages the rebound or back planar surface 60 of the assembly 40 so that the surface 60 and the datum surface 38 are in a common plane. A cup 72 receives a block or pad 75 of shock deadening, energy absorbing rubber or cellular foam material. The cup 72 forms a close fit within the case portion 11*a* and is retained in place by a crimped or turned-in end 76 of the case 11. The forward annular edge of the cup 72 is also in abutment at the radial datum surface 38, and in this position the depth of the cup and the thickness of the block 75 contained therein provides a slight precompression to the block 75 and assures that the impact disc 70 rests in a normally seated position on the surface 38, as shown in FIG. 2.

Thus, the impact disc 70, which may be formed of thin metal or plastic, such as du Pont "Delrin 500", together with the block 75, defines an impact and rebound means within the case 11, and the disc 70 defines a rearward abutment for the armature assembly 40 at the datum surface 38. In the assembled position, the arms 56 of the spring 55 are slightly deflected or prestressed such as to tend to urge the armature 40 in its seated or retracted position. In this position, an axial working air gap 78 is formed between the forward end of the armature element 41 and the adjacent rearward end of the core 22. The gap 78 defines the extent of movement of the armature and may be in the order of 0.020" to 0.025". This gap, in assembly, is accurately maintained since the stator or bobbin assembly 15 on the one hand and the armature assembly 40 on the other hand are designed and injection molded to common datum planes.

The extensions or tabs 59 formed on the body 50 of the armature assembly 40 increase the area of the rebound surface 60 by means of which the impact energy of the returning armature assembly 40 is transmitted to the disc 70 and is absorbed by the block 75.

An electric energizing coil 80 is wound in the bobbin on the central tubular section 19 between the front and rear walls 17 and 18 and the leads therefrom may be extended through the wall of the case 11 by any conventional means.

Figure 11:
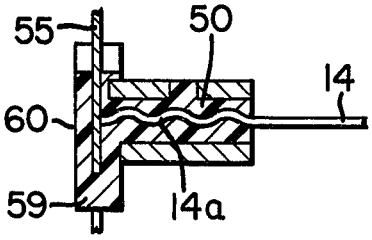
FIG. 11 is a fragmentary section of an armature assembly similar to FIG. 7 showing a modified arrangement for securing the print wire.
Figure 12:
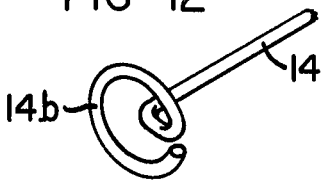
FIG. 12 is a perspective view of the inner end of another modified form of the print wire.

The embodiment of the armature assembly in FIG. 11 shows a modified arrangement by means of which the wire 14 may be encapsulated therein. In this embodiment, the inner end 14*a* of the wire 14 is formed in a wavy manner within the interior of the armature 41 to increase the surface thereof in contact with the plastic body 50. In FIG. 12, a further modification of the wire 14 is shown in which a pigtail or loop 14*b* is formed at the inner end of the wire in lieu of the downwardly turned end 52 of FIG. 7. The loop 14*b* would be captured within the assembly 40 against the inside surface of the spring 55, to secure the wire 14 within the armature assembly.

While a print wire solenoid has been described as a preferred embodiment, it will be apparent that structural features thereof may be used with advantage in axial solenoids, generally, such as low-cost tubular solenoids and the like. The unitary stator structure as shown in FIG. 5 can have particular advantage in providing a low-cost stator assembly for axial solenoids in general, and thus a core may be encapsulated within an injection molded plastic body which, at the same time, forms an axial forward extension providing a mounting attachment for the solenoid, and with an opposite axial or tubular coil receiving surface for receiving an energizing coil. Similarly, a unitary armature assembly may be employed as shown in FIG. 7 in which a plastic body supports an armature and encapsulates the central portion of a leaf-type spring with radially extending spring leafs or spring portions, substantially as shown. A suitable non-magnetic actuating rod may be substituted for the wire 14 or alternatively, the plastic body may be axially extended to a region outside the solenoid for the purpose of performing useful work.

While it is not necessary to provide the longitudinal slits in either the armature or stator, corresponding respectively to the slits 43 and 23 described above, these slits serve to divide the respective magnetic structures with the resulting increase in magnetic surface areas and decrease in response time, eddy currents, and like. However, in applications where lower forces or slower response times may be satisfactory, either or both may be omitted, to permit the use of lower cost components.

The operation of the solenoid is largely self-evident from the foregoing description. In the case of a print head solenoid the plurality of the individual solenoids 10 would be mounted in a suitable printhead and, as noted above, many variations may be made in the configuration of the extension 12 to accommodate varying mounting arrangements. The solenoid coil 80 is operated from a source of DC voltage and upon energization, the armature assembly 40 is attracted to the core 22 by reason of magnetic flux across the air gap 78. The case 11 comprises the magnetic return path as it is magnetically coupled to the core ring 20 and the stator ring 30. The forward movement of the armature assembly 40 drives the print wire 14 into impact with the printing medium and results in slight deflection of the arms 56 of the retraction spring 55. When the solenoid is de-energized, the spring 55 returns the armature assembly 40 to its rest position and the impact is transmitted to the impact plate or disc 70, and the energy is absorbed by the block 75. The injection molding of the print wire 14 within the body securely fastens the print wire to the armature. Relatively high force-to-size ratios and high speed operations are achieved by reason of the longitudinal slit 43 in the armature 41, and the corresponding longitudinal slit 23 in the core 22.

While the forms of apparatus herein described constitute preferred embodiments of this invention, it is to be understood that the invention is not limited to these precise forms of apparatus and that changes may be made therein without departing from the scope of the invention.

What is claimed is:

1. A print wire solenoid comprising:

(1) An injection molded unitary bobbin and stator assembly, including:
- (a) plastic bobbin means having spaced front and rear walls and an interconnecting central section for receiving a coil of electric wire,
- (b) means in said bobbin defining an axially extending metallic core received at least partially within said bobbin central section,
- (c) a metal stator received within said rear wall,
- (d) means on said rear wall defining a datum surface, (2) an injection molded unitary armature and retraction spring assembly, including:
- (a) a plastic support body,
- (b) an armature on said body and proportioned to extend into the interior of said bobbin in spaced relation to said core defining an air gap therewith,
- (c) a print wire having one end anchored in said body and extending axially of said armature through said stator assembly,
- (d) spring means in said body having radially extending portions in engagement with said stator assembly, and
- (e) means on said body defining a rear rebound surface, (3) case means surrounding said bobbin assembly having a forward end thereof engaged at said bobbin front wall, and (4) energy absorbing rebound means in said case positioned on said datum surface and engaging said armature body at the rebound surface.

2. A print wire solenoid comprising:

(1) a bobbin and stator assembly, including:
- (a) a plastic bobbin having spaced front and rear walls and a central section for receiving a coil of electric wire,
- (b) means in said stator assembly defining a core ring in said front wall and an axially extending hollow core received within said bobbin central section extending from said ring toward said rear wall,
- (c) a stator ring received within said rear wall, (2) an armature and retraction spring assembly, including:
- (a) a plastic support body,
- (b) an armature on said body and proportioned to extend through said stator ring into the interior of said bobbin in spaced relation to said core defining an air gap therewith,
- (c) a print wire having one end anchored in said body and extending axially of said armature through said core and core ring,
- (d) spring means in said body having arms in engagement with said stator assembly,
- (e) means on said body defining a rear rebound surface, and (3) resilient rebound means positioned to engage said armature body at said rebound surface.

3. A print wire solenoid comprising:

(1) an injection molded unitary bobbin and stator assembly, including:
- (a) a plastic bobbin having spaced front and rear radial walls and a tubular central section for receiving a coil of electric wire,
- (b) a combined mounting and print wire guide extension formed as an integral part of said bobbin and extending axially forward of said front wall,
- (c) a metal core ring in said front wall,
- (d) an axially extending hollow metallic core received within said bobbin central section magnetically coupled to said core ring and extending from said ring toward, but spaced from, said rear wall,
- (e) a metal stator ring received within said rear wall, (2) an injection molded unitary armature and retraction spring assembly, including:
- (a) a plastic support body,
- (b) a tubular metal armature on said body proportioned to extend into the interior of said bobbin in spaced relation to said core,
- (c) a print wire having one end anchored in said body and extending axially of said armature through said core and guide extension,
- (d) a leaf spring in said body having radially extending portions in abutment with said rear wall of said stator assembly, (3) case means surrounding said bobbin and stator assembly having a forward end thereof engaged at said bobbin front wall and having a rear end thereof in engagement with said rear wall, (4) resilient rebound means interposed between said case rear end and said armature defining the retracted position of said armature, and (5) a coil of electric wire received in said bobbin.

4. As a subcombination of a print wire solenoid, an improved armature assembly comprising an injection molded plastic support body, an armature encapsulated in said body, a print wire having one end molded in saidbody and extending axially of said armature, and a retraction spring molded in said body.

5. The assembly of claim 4 in which said one end is in abutment with said spring.

6. An improved injection molded stator assembly for a solenoid comprising a plastic body having a front wall, a rear wall and a connecting tubular section for receiving a coil of wire, a core encapsulated at least partially in said tubular section, a core ring encapsulated in said front wall surrounding one end of said core, and a stator ring incapsulated in said rear wall.

7. A solenoid comprising:

(1) a bobbin and stator assembly, including:

(a) a plastic bobbin having spaced front and rear walls and a central section for receiving a coil of electric wire, (b) means in said stator assembly defining a core ring positioned in said front wall and an axially extending hollow core received within said bobbin central section extending from said ring toward said rear wall, (c) a stator ring positioned within said rear wall, (2) an armature assembly, including:

(a) a plastic support body, (b) an armature on said body and proportioned to extend through said stator ring into the interior of said bobbin in spaced relation to said core defining an air gap therewith, (c) an actuator having one end anchored in said body and extending axially of said armature through said core and core ring, and (3) case means surrounding said bobbin and stator assembly forming a magnetic return path between said stator ring and core ring and retaining said armature assembly in said bobbin and stator assembly.

8. In a solenoid the improvement in armature construction comprising an injection molded body, an armature molded in said body and forming a unitary part thereof, and a leaf-type retraction spring having a central portion encapsulated in said body and having spring portions extending outwardly of said body.

9. An improved stator construction for a solenoid comprising an injection molded plastic body having spaced front and rear walls, and a central tubular section for receiving a coil of electric wire thereon between said walls, a stator core encapsulated in said body in said tubular section, and said front wall further having an integral portion extending forwardly thereof providing a mounting attachment for the solenoid.

10. The stator construction of claim 9 further comprising a core ring encapsulated in said front wall and a stator ring encapsulated in said rear wall.

* * * * *